US010327542B2

(12) United States Patent
Oberndörfer

(10) Patent No.: US 10,327,542 B2
(45) Date of Patent: Jun. 25, 2019

(54) FRAME STRUCTURE FOR A TABLE

(71) Applicant: DewertOkin GmbH, Kirchlengern (DE)

(72) Inventor: Andreas Oberndörfer, Bielefeld (DE)

(73) Assignee: DewertOkin GmbH, Kirchlengern (DE)

( * ) Notice: Subject to any disclaimer, the term of this patent is extended or adjusted under 35 U.S.C. 154(b) by 0 days.

(21) Appl. No.: 15/565,997

(22) PCT Filed: Apr. 12, 2016

(86) PCT No.: PCT/EP2016/058031
§ 371 (c)(1),
(2) Date: Oct. 12, 2017

(87) PCT Pub. No.: WO2016/166109
PCT Pub. Date: Oct. 20, 2016

(65) Prior Publication Data

US 2018/0110325 A1 Apr. 26, 2018

(30) Foreign Application Priority Data

Apr. 13, 2015 (DE) ..... 10 2015 105 588

(51) Int. Cl.

| | |
|---|---|
| ***F16M 11/16*** | (2006.01) |
| ***A47B 13/00*** | (2006.01) |
| ***A47B 13/06*** | (2006.01) |
| ***A47B 21/00*** | (2006.01) |

(52) U.S. Cl.
CPC ..... *A47B 13/003* (2013.01); *A47B 13/06* (2013.01); *A47B 21/00* (2013.01)

(58) Field of Classification Search
CPC ..... A47B 13/003; A47B 1/08; A47B 9/20; A47B 2013/006; A47B 13/06
USPC ..... 248/188, 125.8, 163.1; 108/137; 211/175
See application file for complete search history.

(56) References Cited

U.S. PATENT DOCUMENTS

| | | | | |
|---|---|---|---|---|
| 6,606,929 | B2 * | 8/2003 | Evreniadis | B26D 1/025 83/167 |
| 2012/0304900 | A1 | 12/2012 | Henriott et al. | |

FOREIGN PATENT DOCUMENTS

| | | | | |
|---|---|---|---|---|
| DE | 3843806 | A1 | 7/1990 | |
| DE | 10200805 | A1 * | 7/2003 | H04B 7/082 |
| DE | 102008051355 | A1 * | 4/2010 | A47B 13/06 |
| DE | 102008051355 | A1 | 4/2010 | |
| EP | 0179198 | A2 | 4/1986 | |

OTHER PUBLICATIONS

Int'l Search Report dated Jul. 13, 2016 in Int'l Application No. PCT/EP2016/058031.

(Continued)

*Primary Examiner* — Todd M Epps
(74) *Attorney, Agent, or Firm* — Panitch Schwarze Belisario & Nadel LLP

(57) ABSTRACT

The invention relates to a frame for supporting a top of a table or desk at a working height, said frame being designed for fastening legs. The frame comprises at least two profiled bodies that can be connected to each other via at least two brackets (10, 12), said brackets (10, 12) being designed to extend over or around edges of the profiled bodies.

11 Claims, 1 Drawing Sheet

(56) References Cited

OTHER PUBLICATIONS

Figure 1:
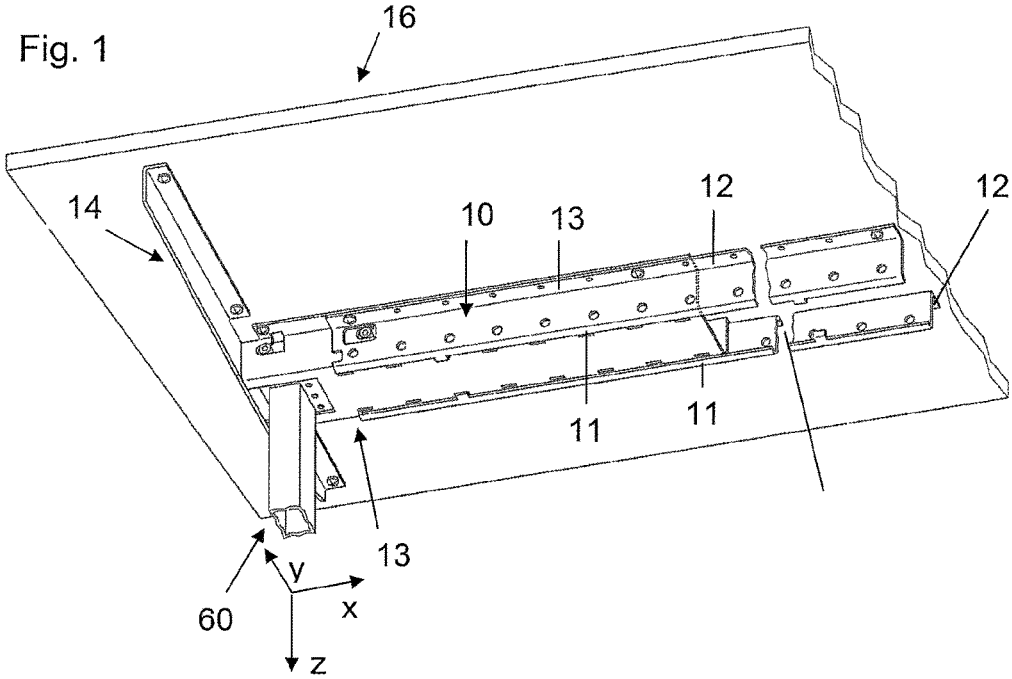

Written Opinion dated Jul. 13, 2016 in Int'l Application No. PCT/EP2016/058031.
Int'l Preliminary Report on Patentability dated Jul. 13, 2016 in Int'l Application No. PCT/EP2016/058031.
Int'l Preliminary Report on Patentability dated Oct. 17, 2017 in Int'l Application No. PCT/EP2016/058031.
Office Action dated Jan. 14, 2016 in DE Application No. 102015105588.0.

* cited by examiner

FRAME STRUCTURE FOR A TABLE

CROSS-REFERENCE TO RELATED APPLICATION

This application is a Section 371 of International Application No. PCT/EP2016/058031, filed Apr. 12, 2016, which was published in the German language on Oct. 20, 2016 under International Publication No. WO 2016/166109 A1, and the disclosure of which is incorporated herein by reference.

The invention relates to a table frame for supporting a table top of a table in a working height, wherein the table frame is further designed for fastening table legs, in particular for height-adjustable table legs of an office table.

Known table frames consist of a plurality of metal profiles, which are welded together, to form a preferably closed profile frame which forms a table plane which extends substantially horizontally in the mounting position and on which a table top is fastened on the top side and the table legs extend further vertically in the mounting position and thus transversely to the table plane, which support the table against the floor, thus extending between the table frame and the floor. Depending on the mounting position of the vertically extending table leg, the table legs can be designed either as T-shaped or L-shaped on the standing table leg in order to realize different installation situations and to improve the tilting stability in the case of larger table loads.

The table tops of office tables usually have a width or depth between 1000-1200 mm and different lengths, preferably 2000 to 2500 mm. Since the table frames are usually set back in relation to the table top, the outer dimensions of the table frames are correspondingly smaller.

In modern tables, the table legs are preferably designed as height-adjustable lifting columns with 2-3 telescopic elements which can be pushed telescopically into one another. The height adjustment is normally carried out electromotively by means of a worm gearing, which engages via a claw coupling into a spindle which is installed in the lifting columns.

Such a table must have a defined transverse and longitudinal stiffness to meet the relevant standards, in particular EN 527-2 and -3, as well as the specifications of the Office Standards Committee in DIN Special Report No. 147 as well as other internationally valid standards.

Disadvantages of the Prior Art

The high storage costs for different table variants and sizes are disadvantageous, since these must usually be welded in a prefabricated manner and, as a result, a relatively large storage space is required for tables of different sizes.

Technical Problem/Object

Based on this prior art, the invention is based on the object of at least partially avoiding these disadvantages and of providing a table frame which at least partially avoids the disadvantages mentioned at the outset and, in particular, significantly reduces the storage costs.

Invention

This object is already achieved in the case of a table frame of the type mentioned at the outset in that the table frame is designed as a modularly connectable plug system, wherein the geometry of the components is selected such that they have the required longitudinal and transverse stiffness of a table frame at least in the assembled state in the mounting position.

The individual parts of the plug system preferably consist of folded or bent metal profiles, in particular with a material thickness of 1.5 to 3 mm. The geometry of the components of the plug system is designed in such a way that they form an inherently rigid frame, either alone or preferably in the mounting position, which has the bending stiffness necessary for a table frame and thus meets the aforementioned requirements.

A particularly good compromise between the compactness of the packed individual parts of the table frame and its stability in the mounting position has proved to be a trough-shaped profiled body which supports the load-bearing capacity, i.e. the bending stiffness of the table frame in the longitudinal direction, which is preferably supported by the brackets.

Preferably, as viewed in the cross-section, the profiled body has a geometry which is channel-like, i.e. circumferentially closed, or trough-shaped, i.e. closed on three sides, with a preferred dimension of 120×60 mm in the cross-section and 500 mm in length. The trough-shaped geometry of the profiled body has the advantage that it is better to stack for transport, but in the mounting position essentially has the same equatorial geometrical moment of inertia against bending as the closed profiled body.

In the mounting position, the trough-shaped profiled bodies form the required longitudinal profiles of the table frame with the brackets which are connected thereto and which preferably encompass them at the edge and fix the position. The brackets are preferably designed in such a way that they can be connected to the profile frame in the mounting position in a stiffness-promoting manner, preferably by overlapping the profile elements at least in sections, in particular the edges of the profiled body or bodies extending in the longitudinal direction. This can, for example, occur by means of hooks on the one component, which engage into corresponding openings on the joining partner in the mounting position. Preferably, several openings are provided in the profiled bodies in order to thus use the profiled bodies for the construction of tables of different size or length.

The brackets are preferably designed in such a way that they engage in a connecting manner over the two profiled bodies arranged in alignment along a common longitudinal axis of the table frame in the mounting position. Thus, the brackets are usually formed in a significantly longer manner than the profiled bodies and are about twice as long as the profiled bodies, but can also be longer.

In the preferred embodiment, the brackets are designed as bent sheet metal profiles with a preferably substantially Z-shaped cross-section, which comprise a longer central leg which defines a bearing surface for abutment on the outside against the vertical leg of the profiled body and from which a table leg extends transversely thereto at an upper end for fastening to the table top and an engaging leg for engaging in openings in the horizontal leg of the profiled body, which is additionally formed with a fastener, in particular integrally formed hooks, for engagement into the openings in the horizontal leg.

Preferably, the table legs can be connected to the profiled bodies. Preferably, the profiled bodies have on each of their front walls a recess for receiving the table legs or the lifting column in the mounting position, which is arranged large enough to permit passage of the lifting column, wherein the motor housing, which is arranged transversely to the longitudinal direction of extension at the top end, is accommodated in the profiled element in the mounting position, preferably in a force-locked and/or form-locking manner. In the preferred embodiment, recesses are provided in the jacket surface of the profiled bodies, into which projections on the motor housing on the outside engage in the mounting position. These recesses can be designed as guide links in order to make the correct installation visible and to further realize clamping of the components with respect to each other in the mounting position or in the end position of the mounting position, preferably by means of a correspondingly designed clamping seat between the motor housing and the profile frame.

A further development provides that the brackets also engage over these recesses in the profile frame with a recess or opening which is correspondingly formed in the mounting position.

Since the stability of the profiled bodies is mainly required in the fastening area of the lifting columns, it is sufficient if the profiled bodies do not extend over the entire length below the table but only in the region of the end of the face ends. It has been recognized that where the lifting columns are connected to the frame, the frame must be particularly rigid. The intermediate region can be designed to save material. This embodiment thus enables a reduction in weight and a simplified design.

Further table components, e.g. a control unit for realizing the synchronous operation of the electric motors in the lifting columns, as well as cables for the power supply and/or connection of the electrical components, can be accommodated and guided within these profiled bodies in a protected and concealed manner, wherein the inlet and outlet of the cables from the profiled bodies can take place either laterally or via additional openings. The profiled bodies thus protect and conceal table components, which are also used as cable or line duct.

In the context of the invention, the term "trough-shaped" is to be understood as a channel-shaped geometry which is formed essentially rectangular in the cross-section. The preferred embodiment has a similar size and geometry as a wall duct for mounting on a wall. In addition, however, profile flanges are provided at the upper free end of the profiled body for fastening to the underside of the table top, preferably formed as a circumferential profile flange.

The fastening of the table legs, preferably designed as height-adjustable lifting columns on the table frame, preferably takes place in such a way that the table legs or their motor housings can be inserted into the profiled bodies in the mounting position, i.e. the profiled body engages around the table legs or the motor housing in the mounting position.

The joining technique between the components may comprise stiffness-promoting clamps. Preferably, these clamps are formed between the profiled body and the table leg and comprise projections, which are provided on one joining partner, e.g. formed as pins, integrally attached projections, screws or the like, which engage in a guide link of the joining partner which thus cooperates in the mounting position. The practically preferred embodiment comprises pins protruding from a box-shaped motor housing at the upper end of the table leg, e.g. in the form of Allen screws, which engage in guide links on the profiled body. Preferably, the guide link has a substantially L-shaped geometry with an insertion leg extending vertically in the mounting position and a clamping leg extending transversely thereto, which also tapers conically towards the end in the direction of insertion in order to clamp the Allen screws therein in the mounting position.

Furthermore, the table frame comprises transverse profiles which absorb the essential load of the table frame in the transverse direction and which can be connected to the remaining components of the table frame. Preferably, these transverse profiles are designed as head pieces, which can be connected to the profiled bodies in transverse extension to the longitudinal axis at the head or face end sides of the table frame. This preferably occurs in such a way that they can also be connected to the table leg or the lifting column at the head end. The connecting means can comprise a clamp or a tensioner which not only connect the components in the mounting position to each other but also clamp them to each other. These head pieces can be, for example, simple angular profiles. Other designs are obviously possible, e.g. with a width which increases from the ends of the head piece towards its center, or with an aesthetic or identifying design of the outer sides, for example with two-dimensional embellishments or company labels. The head pieces can also be designed and/or mounted asymmetrically, e.g. when the lifting columns are not aligned with the center longitudinal axis of the table top.

According to a preferred development, all the components of the table frame are formed on the table end which is at the top in the mounting position for fastening to the underside of the table top, preferably comprising at least one flange with several holes, in particular equidistantly spaced holes, into which suitable fastening screws can be inserted into the underside of the table top. In this case, the openings are designed in such a way that screws can penetrate the openings of several components at the same time in the mounting position, so that the components thus engage over each other in the mounting position.

Between the brackets and trough-type profiles 4, 6, bores or holes can be provided which are arranged in a corresponding, therefore overlapping, manner, through which connecters can be introduced which connect the two joining partners in the mounting position. Thus, a fixed and non-displaceable/form-locking connection between trough-type profiles and brackets is preferably realized on the lateral vertical legs. Preferably, expansion rivets are used for the connection, which are braced circumferentially in the holes, i.e. they form position-fixing clamping sleeves within the holes formed in a corresponding or aligned manner.

The invention thus also relates to a table frame assembly comprising the above-described components for constructing the table frame that can be assembled modularly, i.e. at least two trough-shaped profiled bodies, at least two brackets, at least two head pieces, at least two table legs, preferably equipped with drive motors, and the necessary wiring and the electronics. The table frame according to the invention is characterized by excellent stability. Therefore, in contrast to known frames, it does not require any so-called cross-member, i.e. no stabilizing connection of the table legs or lower sections of the lifting columns, which undesirably would restrict the leg-freedom of the users. In the practical embodiment, the tables with the frame according to the invention exhibited excellent results for deflection and vibration damping in the swing hammer test according to the above-mentioned standards. A preferred exemplary embodiment of the invention is illustrated by way of example and in a non-limiting manner in the drawings and is described in more detail below. In the detailed description, reference is made to the accompanying drawings which form a part hereof, and in which specific embodiments are shown by way of illustration in which the invention may be implemented. In this regard, directional terminology such as "top", "bottom", "front", "rear", "forward", "backward", etc. is used with respect to the orientation of the described figure(s). Since components of embodiments can be positioned in a number of different orientations, the directional terminology serves for illustration and is by no means limiting. It is to be understood that other embodiments may be used and structural or logical changes may be made without departing from the scope of protection of the present invention. The following detailed description is not to be taken in a limiting sense. Within the scope of this description, the terms "connected", "linked" and "integrated" are used to describe both a direct and indirect connection, a direct or indirect attachment as well as a direct or indirect integration. In the figures, identical or similar elements are provided with the same reference numerals, as far as this is appropriate.

The illustrations in the figures are essentially true to scale. However, for the sake of illustrating details, certain areas can be clearly shown on an excessive scale so as to be recognizable for the persons skilled in the art. Moreover, the drawings can be flawlessly simplified and do not include every detail existing in the practical embodiment.

Figure 2:
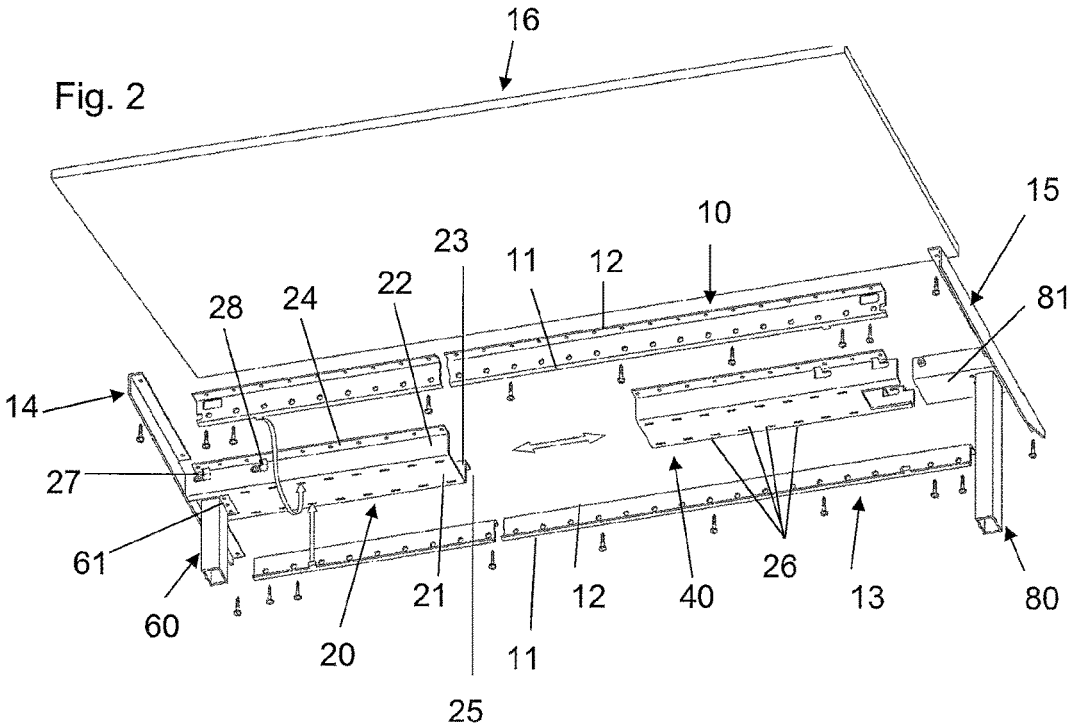

The drawings show as follows:

FIG. 1 shows a partial perspective view of a table frame according to the invention, mounted under a table top; and FIG. 2 shows a perspective exploded view of the table frame according to FIG. 1.

The Cartesian coordinate system shown in FIG. 1 indicates the directions where the X axis indicates the longitudinal axis, the Y axis the transverse direction and the Z axis the height of the table or the system. FIG. 1 shows a table frame according to the invention.

The frame rack according to the invention, which can be assembled in a modular manner and is shown in the drawings, is essentially composed of two profiled bodies configured as trough-type profiles 20, 40, two height-adjustable lifting columns 60, 80, two brackets 10, 13 and two head pieces 14, 15. All components described above are designed as folded steel profiles with a wall thickness of 2.5 mm.

The details on the construction of the components are described in each case only for one component in order to avoid overloading the figures and because the component is constructed in pairs in a corresponding manner.

Each trough-type profile 20, 40 is formed in the manner of a channel, comprising a lower horizontal leg 21 which preferably extends parallel downwards in an offset manner to the supporting plane defined by the table frame for the table top 16, and from which two vertical legs 22, 23 extend in each case at right angles and parallel to one another, which at the upper free ends extend at a right angle to the vertical legs into outwardly projecting mounting flanges 24, which serve for mounting on the table top 16 and increase the longitudinal stiffness.

To further increase the longitudinal rigidity, the brackets 10, 13 are placed on both sides on the outer sides of the vertical legs 22, 23; 42 of the trough-type profiles 20, 40 arranged in alignment in the mounting position, so that these brackets 10, 13 engage with hook ends on the hook sections 11 in positioning openings 26 in the trough-type profiles 20, 40, which in this case are provided to extend in equal distances in the longitudinal direction on both sides in the horizontal leg 21 of the trough-type profile 20, 40 in order to enable different mounting situations or sizes. The brackets 10, 13 sit close in the mounting position to the vertical legs 22, 23 of the profiled bodies 2, 4 by engaging over them on the outside and engage, with a first hook section 11, over the edge between the vertical legs 22, 23 and the horizontal legs 21 of the trough-type body 20, 40 at its one end and, with a second positioning flange 12, the edge between the vertical legs 22, 23 and the mounting flanges 24, 25 of the trough-type profiles 20, 40. The wood or fastening screws can now be screwed through the positioning flange 12 of the brackets 10, 13 and the mounting flanges 24, 25 of the profiled bodies 20, 40 into the underside of the table top 16.

A possible distance between the two trough-type profiles 20, 40 which are fastened coaxially to the top ends of the table can be bridged via a correspondingly adapted intermediate element (not shown), which is geometrically adapted to the trough-type profiles, but does not have to assume a load-bearing function. In an alternative embodiment, the profiled bodies or trough-type profiles 20, 40 abut each other in the mounting position or are formed so that they can receive each other or be pushed into one another.

Each lifting column 60, 80 consists in this case of three rectangular profiles, which can be pushed into each other telescopically and the first and largest of which is connected to the table leg at the lower end, in which a second center profile with an outer dimension in accordance with the inner dimension of the first profile is accommodated in a relatively movable manner, in which in turn a third profile is arranged relatively movably, the outer dimension of which is in turn adapted to the internal dimension of the second profile. At the upper end of the third profile, a box-like motor housing 6*a*, 8*a* for accommodating an electric motor is fastened transversely to the lifting column 60, 80. The built-in electric motor drives via a worm gearing a claw clutch which twists a spindle which extends in the lifting column for the longitudinal adjustment of the lifting column and thus for the height adjustment of the table.

Two Allen screws are provided in each case on both sides on the outside of the box-shaped motor housing, i.e. a total of four screws.

The Allen screws on the outer longitudinal sides of the box-like motor housing 61, 81 are now clamped in the L-shaped guide links 27, 28 in the vertical legs 22, 23 of the profiled bodies 20, 40 on the inside. Each of these guide links 27, 28 consists of a recess in the vertical leg 22, 23, which comprises a closed end, i.e. a blind recess. In the present embodiment, each guide link 27, 28 substantially has an L-shaped geometry with a vertical section and a horizontal section extending transversely thereto. During assembly, the trough-type profiles 20, 40 are connected to the vertical legs 22, 23; 42 in an aligned manner relative to the Allen screws on the motor housing 61, 81 and then displaced relative to the stationary motor housings 61, 81 to the face end until the Allen screws are clamped into the conically tapered ends of the horizontal sections of the guide links 27, 28. This clamping seat is then screwed to the outer side of the motor housing 61, 61 by screwing the transversely extending head pieces 14, 15, and the Allen screws projecting from the motor housing are end-braced into the conically tapered horizontal sections of the guide links 27, 28.

If this table frame is to be used for another table with different dimensions, the individual elements can be removed from the underside of the table top 16 and used for the other table. For tables of different depth, only head pieces 14, 15 of different sizes are required as variants. The remaining components, however, are standardized.

In an advantageous embodiment, the trough-type profiles 20, 40 are placed one behind the other in a packaging unit, wherein the brackets 10, 13 and the head pieces 14, 15 are inserted into the trough-type profiles 20, 40. The sum total of the length of both trough-type profiles 20, 40 corresponds to the overall length of the brackets 10, 13. Advantageously, the dimension of 1.20 m of the entire overall length of the packaging unit is not exceeded, which enables particularly efficient stacking and transporting of the packaging units. In a preferred embodiment, the brackets 10, 13 have an overall length of 1.00 m and each trough-type profile has an overall length of 0.50 m. Table frames for table tops 20 can thus be produced in a range from 1.20 m to 2.50 m.

Another embodiment, which is not shown in detail, provides an integral trough-type profile 20, 40. Here, guide links 27, 28 can be introduced into a central region of the trough-type profile 20, 40 if a table frame with only one lifting column is to be produced. A different alternative is provided by an integral trough-type profile 20, 40 with guide links 27, 28 in the respective end areas according to FIGS. 1 and 2, when a two-column table frame is to be produced with a predetermined size.

The subject matter of the present invention is derived not only from the subject matter of the individual patent claims, but also from the combination of the individual patent claims. All details and features disclosed in the documents, including the abstract, in particular the spatial configuration shown in the drawings, are claimed as being essential according to the invention insofar as they are novel, individually or in combination, in comparison with the prior art.

LIST OF REFERENCE NUMERALS

20 Trough-type profile
21 Horizontal leg
22 Vertical leg
23 Vertical leg
24 Mounting flange
25 Mounting flange
26 Positioning opening
27 Guide link
28 Guide link
40 Trough-type profile
41 Horizontal leg
42 Vertical leg
60 Lifting column
61 Motor housing
80 Lifting column
81 Motor housing
10 Bracket
11 Hook section
12 Positioning flange
13 Bracket
14 Head piece
15 Head piece
16 Table top

The invention claimed is:

1. A table frame for supporting a table top of a table in a working height, which is designed for fastening table legs and is formed as a modularly connectable plug system, wherein the table frame comprises at least two profiled bodies having edges extending in a longitudinal direction, the profiled bodies being connectable to one another via at least two brackets, wherein the brackets are connectable to the profiled bodies in an assembled position in a stiffness-promoting manner, by the brackets overlapping the profiled bodies at least in sections, with the brackets extending over or around the edges of the profiled bodies, wherein each profiled body is configured to receive a table leg, and wherein a stiffness promoting clamp is formed between the profiled body and the table leg, and wherein the clamp comprises a projection, which is formed on one of the profiled body and the table leg, and wherein the projection engages a guide link of at least one of the profiled body and the table leg in the assembled position.

2. A table frame according to claim 1, wherein the brackets are designed to be hooked into the profiled bodies.

3. A table frame according to claim 2, wherein the brackets are about twice as long as the profiled bodies.

4. A table frame according to claim 1, wherein the profiled bodies are designed in a trough-shaped or channel-shaped manner.

5. A table frame according to claim 1, wherein said frame comprises transverse profiles for realizing a transverse stiffness.

6. A table frame according to claim 5, wherein the transverse profiles are designed as head pieces.

7. A table frame according to claim 6, wherein each of the head pieces is connectable to a profiled body and a table leg.

8. A table frame according to claim 1, wherein a first component comprises a first one of the profiled bodies and the brackets, and wherein a second component comprises a second one of the profiled bodies and the brackets, and wherein a connecter at least partly clamps the first component and the second component against one another in the assembled position.

9. A table frame according to claim 1, wherein the profiled bodies are connected to one another with a distance therebetween via the brackets.

10. A table frame according to claim 9, wherein the brackets are not load-bearing.

11. A table frame for supporting a table top of a table in a working height, which is designed for fastening table legs and is formed as a modularly connectable plug system, wherein the table frame comprises at least two profiled bodies connectable to one another via at least two brackets, wherein the brackets are formed to extend over or around edges of the profiled bodies, wherein at least one guide link is mounted on one of the table leg and the profiled bodies, and wherein a stiffness promoting clamp is provided and is located between a profiled body and a table leg, and the clamp comprises a projection on one of the profiled body and the table leg, wherein the projection is configured to mate with the guide link on one of the profiled body and the table leg in an assembled position, wherein the guide link comprises a substantially L-shaped geometry with an insertion leg extending vertically in the assembled position and a clamping leg extending transversely thereto, which also tapers conically towards an end in a direction of insertion in order to clamp the projection therein in the assembled position.

* * * * *